US009768522B2

(12) United States Patent
Harwath et al.

(10) Patent No.: US 9,768,522 B2
(45) Date of Patent: Sep. 19, 2017

(54) INTERFACE BETWEEN COAXIAL CABLE AND CONNECTOR AND METHOD FOR FORMING SAME

(71) Applicant: CommScope Technologies LLC, Hickory, NC (US)

(72) Inventors: Frank A. Harwath, Naperville, IL (US); Jeffrey D. Paynter, Momence, IL (US); James P. Fleming, Orland Park, IL (US); David J. Smentek, Lockport, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/346,803

(22) Filed: Nov. 9, 2016

(65) Prior Publication Data

US 2017/0133769 A1 May 11, 2017

Related U.S. Application Data

(60) Provisional application No. 62/253,505, filed on Nov. 10, 2015.

(51) Int. Cl.
*H01R 13/62* (2006.01)
*H01R 4/02* (2006.01)
*H01R 24/40* (2011.01)

(52) U.S. Cl.
CPC ..... *H01R 4/024* (2013.01); *H01R 24/40* (2013.01)

(58) Field of Classification Search
CPC ..... H01R 13/622; H01R 9/0521; F21S 6/00
USPC ..... 439/320, 322, 323, 312, 313
See application file for complete search history.

(56) References Cited

U.S. PATENT DOCUMENTS 3,435,387 A * 3/1969 Reinke ..... H01R 13/7197 333/183
3,525,799 A * 8/1970 Ellis ..... H01R 4/723 174/84 R
5,802,710 A * 9/1998 Bufanda ..... H01R 9/05 29/828
2004/0089463 A1 5/2004 Nguyen et al.
2014/0076958 A1 3/2014 Van Swearingen
2015/0101189 A1 4/2015 Paynter et al.
2017/0018901 A1* 1/2017 Paynter ..... H01R 43/02
(Continued)

FOREIGN PATENT DOCUMENTS

KR 20090097778 A 9/2009

*Primary Examiner* — Phuongchi T Nguyen
(74) *Attorney, Agent, or Firm* — Myers Bigel, P.A.

(57) ABSTRACT

A method of forming a joint between a coaxial cable and, a coaxial connector includes the steps of: preparing a cable having an inner conductor, a dielectric, a corrugated outer conductor surrounding the dielectric layer, and a jacket such that an end of the inner conductor is exposed, an end of the outer conductor is exposed arid is flattened to form a ring devoid of corrugations, and a portion of the dielectric layer is cored out to form a solder chamber between the inner conductor and the ring of the outer conductor; preparing an assembly comprising a coaxial connector comprising an inner contact, a dielectric spacer, and an outer conductor body having a tail, with a solder preform encircling the tail; inserting the tail and solder preform into the solder chamber; and melting the solder preform to create a joint between the ring and the tail.

19 Claims, 5 Drawing Sheets

(56) References Cited

U.S. PATENT DOCUMENTS

| | | | | |
|---|---|---|---|---|
| 2017/0040766 | A1* | 2/2017 | Van Swearingen .. | B23K 35/362 |
| 2017/0133769 | A1* | 5/2017 | Harwath ..... | H01R 24/40 |

* cited by examiner

INTERFACE BETWEEN COAXIAL CABLE AND CONNECTOR AND METHOD FOR FORMING SAME

RELATED APPLICATION

The present application claims priority from and the benefit of U.S. Provisional Patent Application No. 62/253,505, filed Nov. 10, 2015, the disclosure of which is hereby incorporated herein by reference in its entirety.

FIELD OF THE INVENTION

The present invention relates generally to a connector and cable interconnection, and more specifically to a connector and cable interconnection method and apparatus with improved manufacturing efficiency and electrical performance characteristics.

BACKGROUND OF THE INVENTION

Coaxial connectors are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between a cable terminated with a connector bearing the desired connector interface and a corresponding connector with a mating connector interface mounted on an apparatus or on another cable. Typically, one connector will include a structure such as a pin or post connected to an inner conductor and an outer conductor connector body connected to the outer conductor; these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

Commonly-owned U.S. Pat. Nos. 5,802,710 and 7,900,344, hereby incorporated by reference in their entireties, disclose a technique for attaching a coaxial connector to a coaxial cable. The connector utilizes an insulating disc retained upon the inner contact and against the dielectric layer and outer conductor of the cable. Induction heating of a solder preform wrapped around the outer conductor creates a molten solder pool in a cylindrical solder cavity formed between the outer conductor, the insulating disc and the connector body. The insulating disc, prevents the molten solder from migrating out of the cavity, fouling the connector bore and/or shorting the outer and inner conductors.

Commonly-owned U.S. Patent Publication No. 2014/0201989, also incorporated herein by reference in its entirety, illustrates a pedestal with an insulating seat on which the soldering of the outer conductor to the connector body can occur. Other techniques for attaching a connector to a cable may also be desirable.

SUMMARY

As a first aspect, embodiments of the invention are directed to a method of forming a joint between a coaxial cable and a coaxial connector. The method comprises the steps of preparing a cable having an inner conductor, a dielectric layer surrounding the inner conductor, a corrugated outer conductor surrounding the dielectric layer, and a jacket surrounding the outer conductor such that an end of the inner conductor is exposed, an end of the outer conductor is exposed and is flattened to form a ring devoid of corrugations, and a portion of the end of the dielectric layer is cored out to form a solder chamber between the inner conductor and the ring of the outer conductor; preparing, an, assembly comprising a coaxial connector and a solder preform, the coaxial connector comprising an inner contact, a dielectric spacer, and an outer conductor body having a tail, the solder preform encircling the tail; inserting the tail and solder preform into the solder chamber; and melting the solder preform to create a joint between the ring of the outer conductor and the tail of the outer conductor body.

As a second aspect, embodiments of the invention are directed to a coaxial cable-connector interface, comprising: a coaxial cable having an inner conductor, a dielectric layer surrounding the inner conductor, a corrugated outer conductor surrounding the dielectric layer, and a jacket surrounding the outer conductor, wherein an end of the outer conductor is, exposed and is flattened to form a ring devoid of corrugation, and a portion of the end of the dielectric layer is cored out to form a solder chamber between the inner conductor and the ring of the outer conductor; and a coaxial connector comprising an inner contact, a dielectric spacer, and an outer conductor body having a tail. The tail is inserted into the solder chamber, and a solder joint interconnects the tail and the ring of the outer conductor.

As a third aspect, embodiments of the invention are directed to a coaxial connector assembly, comprising a coaxial connector and a solder preform. The coaxial connector comprises an inner contact, an outer conductor body, and a dielectric spacer interposed between the inner contact and the outer conductor body. The outer conductor body has a main sleeve, a forwardly-extending mating ring configured to mate with a mating connector and a rearwardly-extending tail, the tail having an outer diameter that is less than an outer diameter of the main sleeve. The solder preform circumferentially surrounds the tail of the outer conductor body.

DETAILED DESCRIPTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided, so that this disclosure will be thorough and complete, and will fully convey the scope of the invention to those skilled in the art. It will also be appreciated that the embodiments disclosed herein can be combined in any way and/or combination to provide many additional embodiments.

Figure 1:
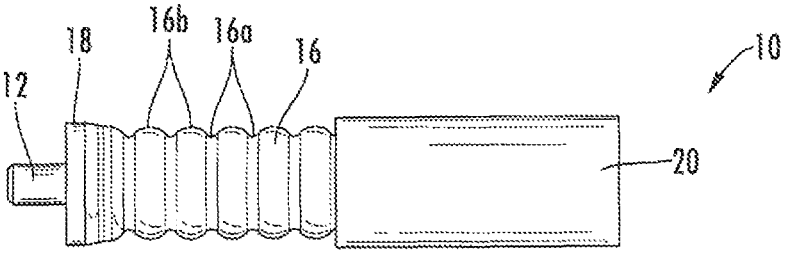
FIG. 1 is a side view of a cable for attachment to a coaxial connector according to embodiments of the invention.
Figure 2:
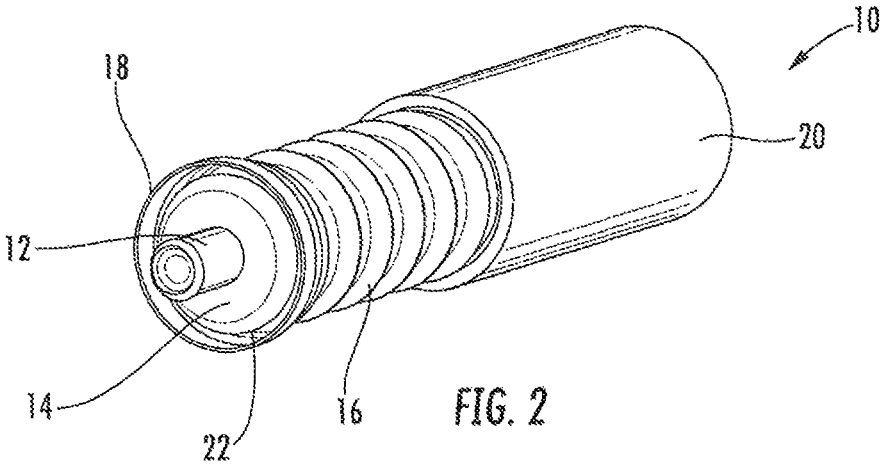
FIG. 2 is a perspective view of the cable of FIG. 1 illustrating a cored-out portion of the dielectric layer.

Unless otherwise defined, all technical and scientific terms that are used in this disclosure have the same meaning as commonly understood by one of ordinary skill in, the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. in contrast, when an element is referred to as being "directly connected" or "directly coupled" to another element, there are no intervening elements present Referring now to the figures, a coaxial cable, designated broadly at 10, is shown in FIGS. 1 and 2. The cable 10 includes a inner conductor 12, a dielectric layer 14 that circumferentially overlies the inner conductor 12, an outer conductor 16 that circumferentially overlies the dielectric layer 14, and a polymeric cable jacket 20 that circumferentially overlies the outer conductor 16. These components will be well-known to those of skill in this art and need not be described in detail herein. FIG. 1 illustrates that the outer conductor 16 has a corrugated profile, with alternating roots 16*a* and crests 16*b*.

FIG. 2 also illustrates that, at the end of the cable 10, at least the last crest of the outer conductor 16 (and in some instances at least the last root) is flattened into a ring 18. The ring 18 has, a diameter that is equal to or exceeds the diameter of the remainder of the crests 16*b*. FIG. 2 also illustrates that the end of the dielectric layer 14 radially inwardly from the ring 18 is cored out, thereby creating an annular solder chamber 22 within the ring 18 (see also FIGS. 6 and 7). In some embodiments, the end of the dielectric layer 14 is cored out entirely, such that the solder chamber 22 extends radially between the ring 18 and the inner conductor 12; in other embodiments, an inner sleeve 19' of the dielectric layer 14 may remain after coring, such a sleeve 19' being interposed between the ring 18 and the inner conductor 12, such that the solder chamber 12 extends radially between the inner sleeve 19' of the dielectric layer 14 and the ring 18 (see FIG. 6A). The solder chamber 22 may have a thickness of between about 0.015 and 0.030 inches.

Figure 3:
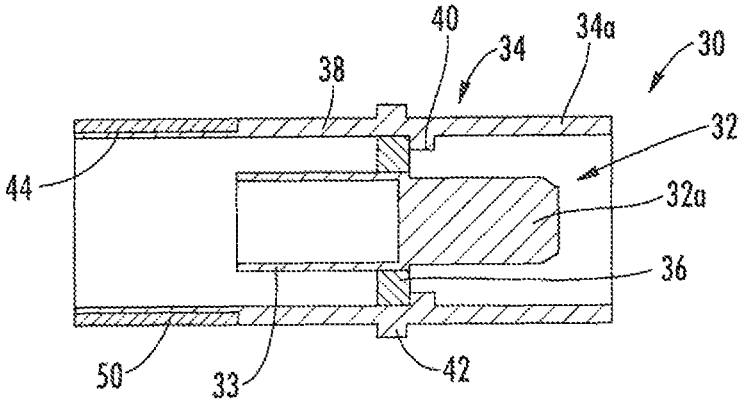
FIG. 3 is a section view of a coaxial connector according to embodiments of the invention, with a solder preform in place over the tail of the outer conductor body.

Referring now to FIG. 3, a coaxial connector, designated broadly at 30, is shown therein. The connector 30 includes an inner contact 32, an outer conductor body 34, and a dielectric spacer 36 positioned between the inner contact and the outer conductor body 34. The inner contact 32 has a generally cylindrical post 32*a* and a split boss 33, The inner contact 32 is configured to be mounted on and in electrical contact with the inner conductor 12 of the cable 10 via the boss 33; the split configuration of the boss 33 allows its tines to deflect slightly radially outwardly to receive the end of the inner conductor 12. The post 32*a* is configured to mate with an inner contact (such as a sleeve) of a mating jack or other connector.

Referring again to FIG, 3, the outer conductor body 34 has a mating ring 34*a* that is configured to mate with the outer conductor body of a mating jack or other connector. A main sleeve 38 of the outer conductor body 34 has a radially inward flange 40 that provides a bearing surface for the dielectric spacer 36 and a radially outward flange 42 that provides a bearing surface for a coupling nut (not shown). A tail 44 extends rearwardly from the main sleeve 38. The tail 44 has an inner diameter similar to that of the main sleeve 38, but has an outer diameter that is less than that of the main sleeve 38.

FIG. 3 also shows an annular solder preform 50 that encircles the tail 44. The solder preform 50 is formed of typical solder materials that melt upon the application of heat energy thereto.

Figure 4:
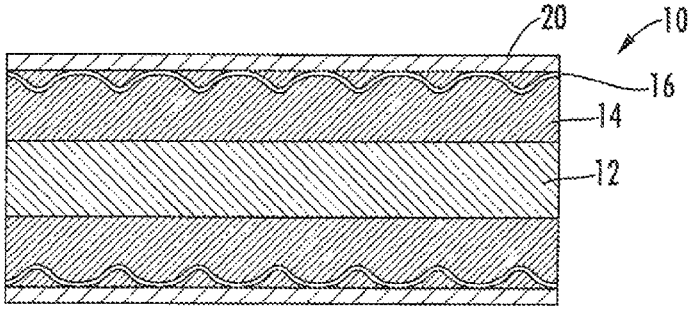
FIGS. 4-8 are sequential section views of a process for attaching the cable of FIGS. 1 and 2 to the connector of FIG. 3.
Figure 5:
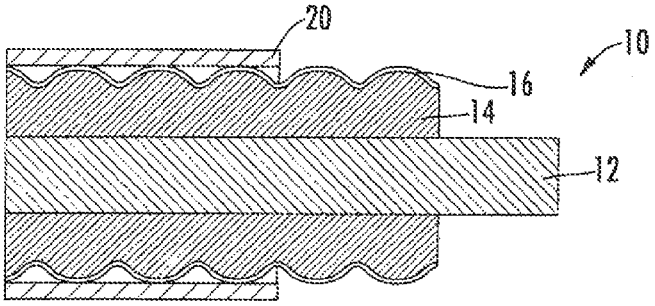
Figure 6:
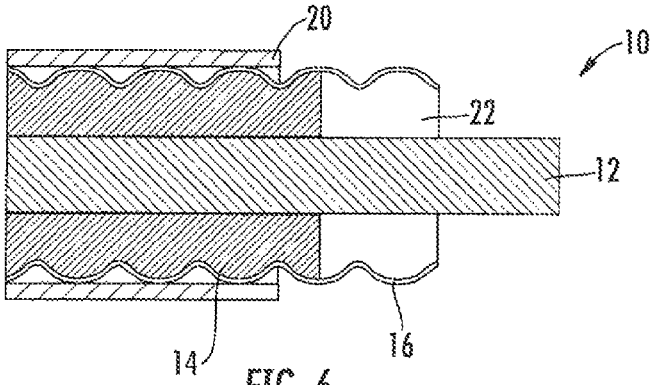
Figure 6A:
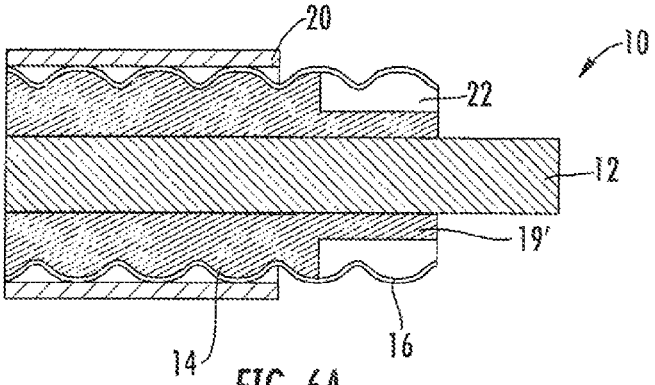

FIGS. 4-8 illustrate how the cable 10 can be connected to the connector 30 in a soldering operation. FIG. 4 shows the end of a length of cable 10 prior to processing. FIG. 5 illustrates the cable 10 with the end of the jacket 20 stripped back and the ends of the outer conductor 16 and the dielectric layer 14 removed, such that end portions of the inner conductor 12 and the outer conductor 16 are exposed, with the end of the outer conductor 16 extending axially beyond the jacket 20 and the end of the inner conductor 12 extending axially beyond the end of the outer conductor 16. FIG. 6 shows that the end of the dielectric layer 14 is cored out to create the solder chamber 22 discussed above.

Figure 7:
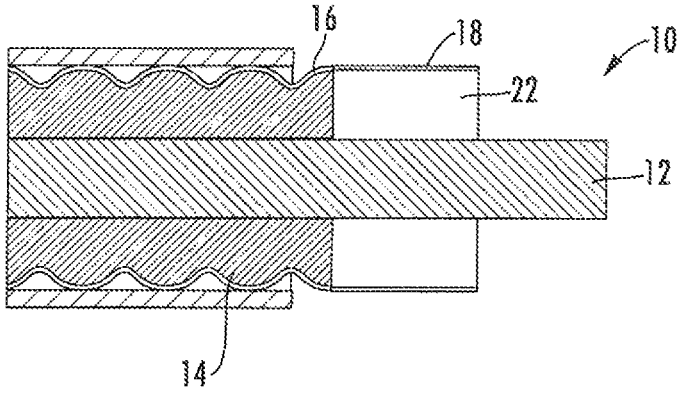

FIG. 7 illustrates that the end of the outer conductor 16 is formed into the ring 18 discussed above. The formation of the ring 18 may be performed with a dedicated tool or fixture that can produce a consistent shape (such as the ring 18) with closely controlled dimensions, Forming corrugations in the outer conductor 16 is typically carried out on a continuously running cable line. The corrugations that are formed under such conditions typically have much greater variations in dimension and shape than can be achieved through the use of dedicated tooling that forms the ring 18. Those of skill in this art will recognize that, as used herein, the term "ring" is intended to include other radially symmetric shapes, such as truncated cones, and to include shapes with one or more radial indentations and/or projections.

Figure 8:
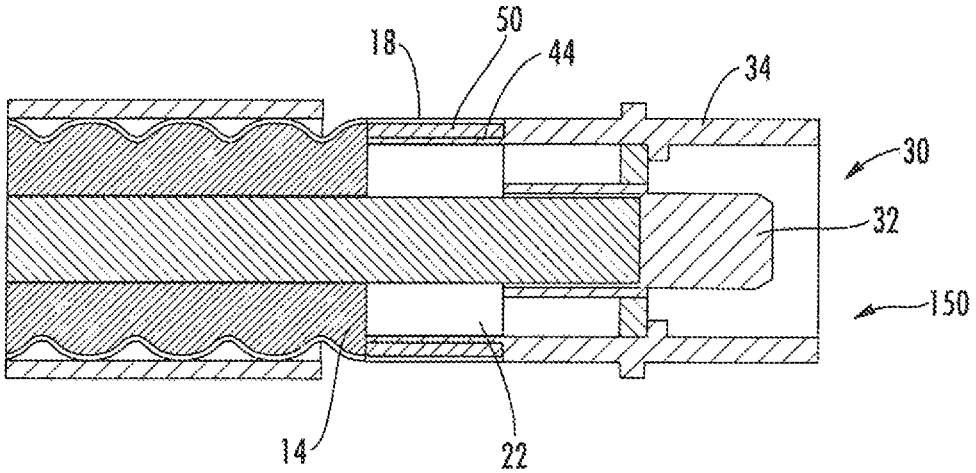

FIG. 8 shows that, once the dielectric layer 14 is cored out to form the solder chamber 22 and the preform 50 is inserted onto the tail 44 of the outer conductor body 34, the connector-preform assembly can be inserted into the solder chamber 22 for soldering. The preform 50 is positioned between the tail 44 and the ring 18 of the outer conductor 16, with the end of the tail 44 abutting the dielectric layer 14. In this position, heat energy can be applied to the solder chamber 22 to melt the solder of the preform 50, thereby forming a solder joint between the outer conductor 16 and the outer conductor body 34. The boss 33 of the inner contact 32 receives the end of the inner conductor 12. The soldered cable and connector form an interface 150.

Because the shape and dimensions of the ring 18 can be more closely controlled than those of a corrugation, the gap between the ring 18 and the tail 44 can be much smaller than typically seen. Thus, a thinner, solder preform 50 may be employed (for example, the solder preform 50 may have a thickness of between about 0.015 and 0.030 inches), thereby reducing the overall solder volume and, consequently, the variability associated with larger gaps and/or solder joints.

Figure 9:
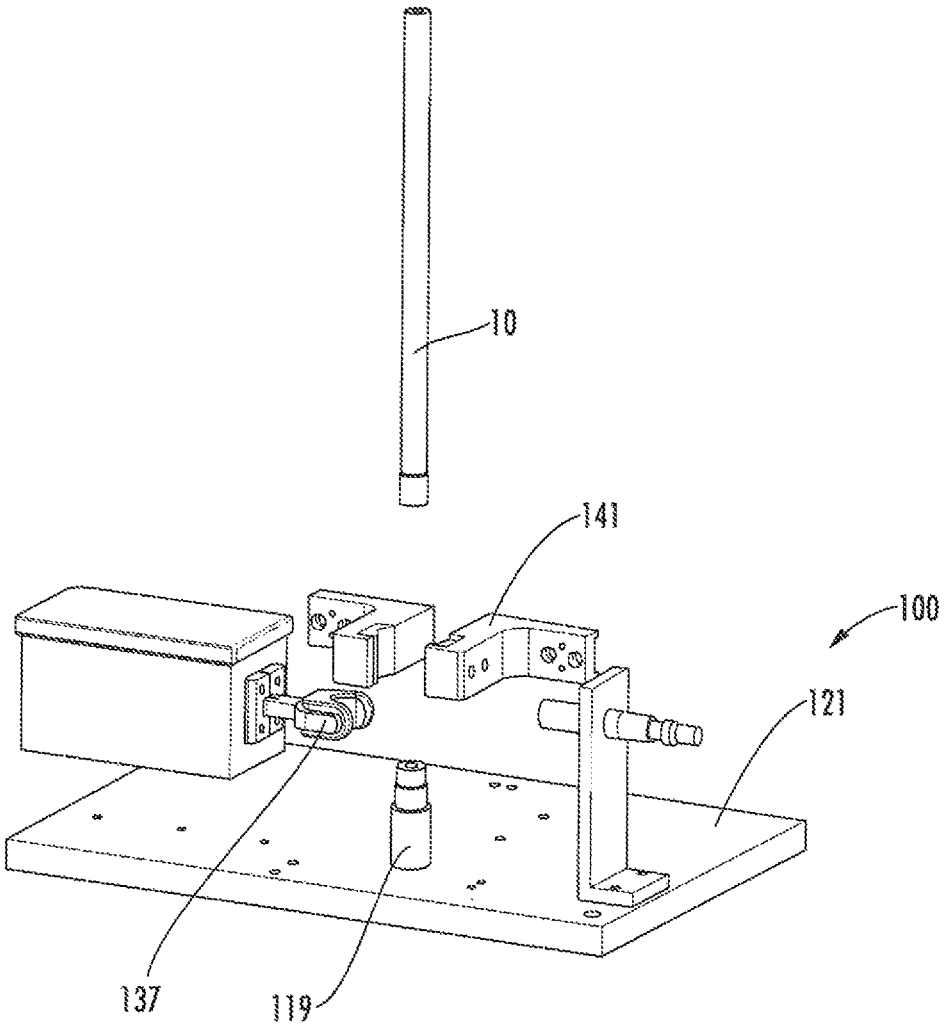
FIG. 9 is a perspective view of an exemplary soldering apparatus according to embodiments of the invention.
Figure 10:
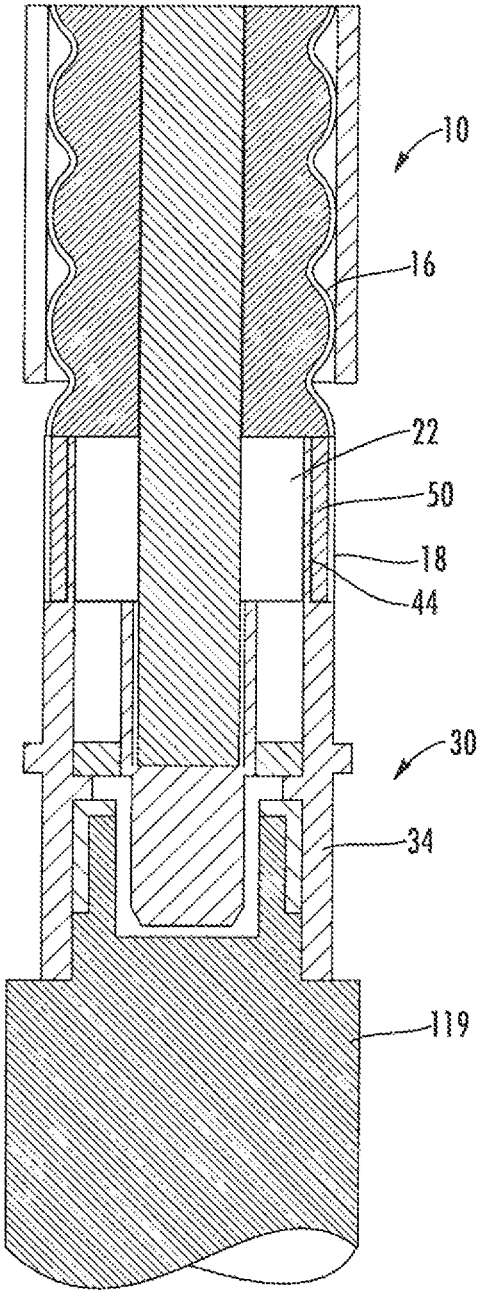
FIG. 10 is a section view of a cable of FIG. 1 and coaxial connector of FIG. 3 in place in the apparatus of FIG. 9 for soldering.

FIG. 9 shows one potential apparatus 100 for conducting the soldering operation that involves a pedestal as disclosed in U.S. Patent Publication No. 2014/0201989, supra. The apparatus 100 includes a pedestal 119 mounted on a base 121, a clamp 141 for holding a cable 10 in place, and an inductive heating element 137 for heating solder used to attach the connector body to the outer conductor of the cable 10. FIG. 10 shows the cable 10, connector 30 and preform 50 of FIG. 8 in place within the apparatus 100, with the connector 30 mounted on the pedestal 119 and the cable 10 lowered onto the connector 30 so that the preform 50 resides within the solder chamber 22. Once in this position, the heating element 137 (shown in FIG. 9) can be used to heat the preform 50 to form a solder joint between the ring 18 of the outer conductor 16 and the tail 44 of the outer conductor body 34 within the solder chamber 22. The solder joint typically has a thickness of between about 0.015 and 0.030 inches.

The interface 150 may provide a soldered interconnection between the cable 10 and the connector 30 that has consistent electrical properties. The presence of the solder chamber 22 can enable the solder joint between the tail 44 of the outer conductor body 34 and the ring 18 of the outer conductor 16 to he consistently formed in size and shape, which can render the connection more predictable. This arrangement can also improve electrical properties such as return loss yield in the cable/connector interface.

Those of skill in this art will appreciate that the soldering operation may occur in different soldering apparatus; for example, the soldering apparatus may include a vacuum source as described in U.S. Provisional Patent Application Nos. 62/160,999, filed May 13, 2015, and 62/131,105, filed Mar. 10, 2015, the disclosures of which are hereby incorporated by reference herein, It is also contemplated that other connector configurations, such as right angle connectors as are shown in U.S. Provisional Patent Application No. 62/111,300, filed Feb. 3, 2015 (also incorporated by reference herein) may also be suitable.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may he made from such details without departure from the spirit or scope of applicant's general inventive concept. Further, it is to be appreciated that improvements and/or modifications may be made thereto without departing from the scope or spirit of the present invention as defined by the following claims.

That which is claimed is:

1. A method of forming a joint between a coaxial cable and a coaxial connector, comprising the steps of:

preparing a cable having an inner conductor, a dielectric layer surrounding the inner conductor, a corrugated outer conductor surrounding the dielectric layer, and a jacket surrounding the outer conductor such that an end of the inner conductor is exposed, an end of the outer conductor is exposed and is flattened to form a ring devoid of corrugations, and a portion of the end of the dielectric layer is cored out to form a solder chamber between the inner conductor and the ring of the outer conductor;

preparing an assembly comprising a coaxial connector and a solder preform, the coaxial connector comprising an inner contact, a dielectric spacer, and an outer conductor body having a tail, the solder preform encircling the tail;

inserting the tail and solder preform into the solder chamber; and melting the solder preform to create a joint between the ring of the outer conductor and the tail of the outer conductor body.

2. The method defined in claim 1, wherein the solder chamber extends radially between the ring of the outer conductor and the inner conductor.

3. The method defined in claim 1, wherein the solder chamber extends radially between the ring of the outer conductor and a portion of the dielectric layer.

4. The method defined in claim 1, wherein the ring has a diameter that is equal to or greater than a diameter of a crest of corrugations of the outer conductor.

5. The method defined in claim 1, wherein the coaxial connector is mounted on a pedestal during the melting step.

6. The method defined in claim 1, wherein the solder preform has a thickness of between about 0.015 and 0.030 inches.

7. The method defined in claim 1, wherein the solder chamber has a thickness of between about 0.015 and 0.030 inches.

8. A coaxial cable-connector interface, comprising:

a coaxial cable having an inner conductor, a dielectric layer surrounding the inner conductor, a corrugated outer conductor surrounding the dielectric layer, and a jacket surrounding the outer conductor, wherein an end of the outer conductor is exposed and is flattened to form a ring devoid of corrugations, and a portion of the end of the dielectric layer is cored out to form a solder chamber between the inner conductor and the ring of the outer conductor; and a coaxial connector comprising an inner contact, a dielectric spacer, and an outer conductor body having a tail;

wherein the tail is inserted into the solder chamber, and wherein a solder joint interconnects the tail and the ring of the outer conductor.

9. The interface defined in claim 8, wherein the solder chamber extends radially between the ring of the outer conductor and the inner conductor.

10. The interface defined in claim 8, wherein the solder chamber extends radially between the ring of the outer conductor and a portion of the dielectric layer.

11. The interface defined in claim 8, wherein the ring has a diameter that is equal to or greater than a diameter of a crest of corrugations of the outer conductor.

12. The interface defined in claim 8, wherein the solder joint interconnects an inner surface of the ring of the outer conductor of the cable and the tail.

13. The interface defined in claim 8, wherein the solder joint has a thickness of between about 0.015 and 0.030 inches.

14. A coaxial connector assembly, comprising:

a coaxial connector comprising an inner contact, an outer conductor body, and a dielectric spacer interposed between the inner contact and the outer conductor body;

wherein the outer conductor body has a main sleeve, a forwardly-extending mating ring configured to mate with a mating connector and a rearwardly-extending tail, the tail having an outer diameter that is less than an outer diameter of the main sleeve; and a solder preform that circumferentially surrounds the tail of the outer conductor body.

15. The assembly defined in claim 14, wherein the solder preform has a thickness of between about 0.015 and 0.030 inches.

16. The assembly defined in claim 14, in combination with a coaxial cable having an inner conductor, a dielectric layer surrounding the inner conductor, a corrugated outer conductor surrounding the dielectric layer, and a jacket surrounding the outer conductor, wherein an end of the outer conductor is exposed and is flattened to form a ring devoid of corrugations, and a portion of the end of the dielectric layer is cored out to form a solder chamber between the inner conductor and the ring of the outer conductor in which the solder preform resides.

17. The combination defined in claim 16, wherein the solder chamber extends radially between the ring of the outer conductor and the inner conductor.

18. The combination defined in claim 16, wherein the solder chamber extends radially between the ring of the outer conductor and a portion of the dielectric layer.

19. The combination defined in claim 16, wherein the ring has a diameter that is equal to or greater than a diameter of a crest of corrugations of the outer conductor.

* * * * *